United States Patent [19]

Hipp

[11] 4,446,932

[45] May 8, 1984

[54] HYDROSTATIC SHEAR PIN

[75] Inventor: James Hipp, New Iberia, La.

[73] Assignee: Petro-Drive, Inc., Lafayette, La.

[21] Appl. No.: 257,257

[22] Filed: Apr. 24, 1981

[51] Int. Cl.[3] ..... E21B 7/06

[52] U.S. Cl. ..... 175/74; 175/61; 285/2

[58] Field of Search ..... 285/2; 166/317; 175/256, 61, 73, 74; 405/184, 251

[56] References Cited

U.S. PATENT DOCUMENTS

| | | | |
|---|---|---|---|
| 2,402,238 | 6/1946 | Carpenter | 175/256 |
| 3,119,298 | 1/1964 | Brown | 285/2 |
| 3,358,770 | 12/1967 | Zandmer | 166/317 |
| 3,717,208 | 2/1973 | Anderson | 175/256 |
| 4,286,662 | 9/1981 | Page, Jr. | 166/317 |

*Primary Examiner*—William F. Pate, III

*Attorney, Agent, or Firm*—Bernard A. Reiter

[57] ABSTRACT

A method and apparatus for controlling the depth at which deviation occurs of a conductor casing driven vertically into the ocean floor from an offshore oil platform. A retractable shear pin engages both members of an articulated joint inserted between two sections of the conductor casing, thus preventing relative movement and locking it into a uniform vertical alignment. This ambient pressure increases with depth, thereby tending to force the shear pin to retract. Movement of the shear pin is internally prevented until the force exerted by the pressure exceeds a desired precalculated valve. The shear pin disengages from the articulated joint, resulting in deviation of the path of the conductor casing at a remote point.

10 Claims, 5 Drawing Figures

HYDROSTATIC SHEAR PIN

BACKGROUND OF THE INVENTION

1. Field of the Invention

This invention relates to conductor casings for oil and gas wells. More specifically, the invention is directed to a new and improved method and apparatus for remotely directing the deviation of the conductor casing of the well as it is being driven into the substratum.

2. Description of the Prior Art

It is commonly known that oil and gas wells are driven at varying slant angles for a variety of reasons. For example, in order to increase the lateral reach of the well, or in order to tap a deposit in a number of locations, the conductors have been driven at a slant, with respect to the vertical. In this procedure, the conductor casing joints generally remain uncurved; see U.S. Pat. No. 3,451,493, although it is known that the conductors have been precurved prior to their being driven into the substratum. Another known method describes the curving of pipe conductor during driving by forcing them through an arcuately arranged path of guide members affixed to the superstructure of the platform; see U.S. Pat. No. 3,670,507. This type of apparatus and method is generally deficient because it precludes versatility in drilling due to the fixed construction of the guide means on the platform, and in any event, the amount of curvature that can be obtained in the casing is predetermined by the preset guide means and may not be readily changed.

Due to the expense, difficulty and lack of flexibility of these methods, it may become desirable to drive the conductor pipe substantially vertically into the substratum and cause it to be deviated thereafter. In this regard, attention may be directed to pending U.S. application Ser. No. 035,635, wherein is shown a method and apparatus for perpendicular insertion and remote deviation of a conductor casing. This is accomplished by providing an articulating shoe or joint between two or more pipe joints. The shoe sections are held in alignment with the longitudinal axis of the conductor casing by shear pins. After the conductor casing has penetrated the ocean floor to the desired depth, the resistant forces resulting from the movement therein reach a level sufficient for the action of the driving hammer to shear the pins and force the articulated shoe to deviate from its alignment, thus altering the path of the conductor casing.

However, this method has limitations because the exact depth at which articulation occurs results from the nature of the substratum and other relatively uncontrollable factors, rather than at predetermined depth controlled by human operation. It is desirable, therefore, to design a means and method for actuating articulation at a predetermined depth, independent of the force of the hammer or the characteristics of the local substratum.

SUMMARY OF THE INVENTION

The present invention offers a reliable means for remotely controlling the depth at which deviation in a conductor pipe or the like occurs by utilizing one or more retracting shear pins. The shear pins engage both members of an articulated joint inserted between two sections of a linearly aligned string of conductor casing, thus preventing deviation. The shears are subjected to the force exerted by the increasing ambient pressures as the conductor casing is inserted into the earth, thus tending to retract the shear pins. The retracting shear pins may be locked in place by appropriate means such as a resistive force. When the means is deactivated, the shear pin will retract, thus allowing articulated movement of the shoe and generally slant movement of the conductor pipe.

It will be observed that the pin locking means may, for example, be comprised of a resistive force that may be varied as desired to alter the depth (shallower or deeper) at which the shear pin will retract. This variation implies an understanding of the pressures present at the desired depths beneath the surface of a body of water or land. By calculating the point at which the forces are equalized, i.e. atmospheric vs water depth pressure, the flexibility of remote deviation at predetermined depths is achieved, independent of the force involved in driving the conductor casing through subfloor formations or other such factors.

Thus, the present invention will facilitate the accuracy of drilling to known deposits. It will markedly reduce the cost of drilling operations by enhancing the probability of oil or gas recovery; and it provides a relatively inexpensive and reliable mechanism for engaging in slant hole operations.

These and numerous other features and advantages of the invention will become more readily apparent upon a careful reading of the following detailed description, claims and drawings, wherein like numerals denote like parts in the several views and wherein:

DETAILED DESCRIPTION

Figure 1:
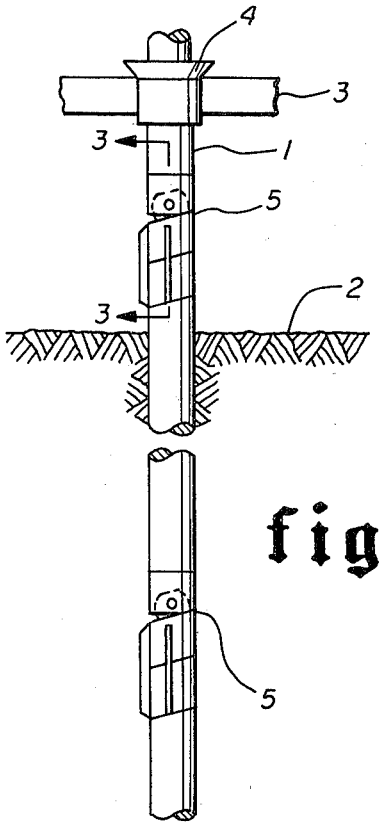
FIG. 1 is a frontal elevation showing the conductor casing and an articulating shoe held in conductor alignment by the hydrostatic shear pins prior to penetration of the floor beneath the surface of a body of water.
Figure 2:
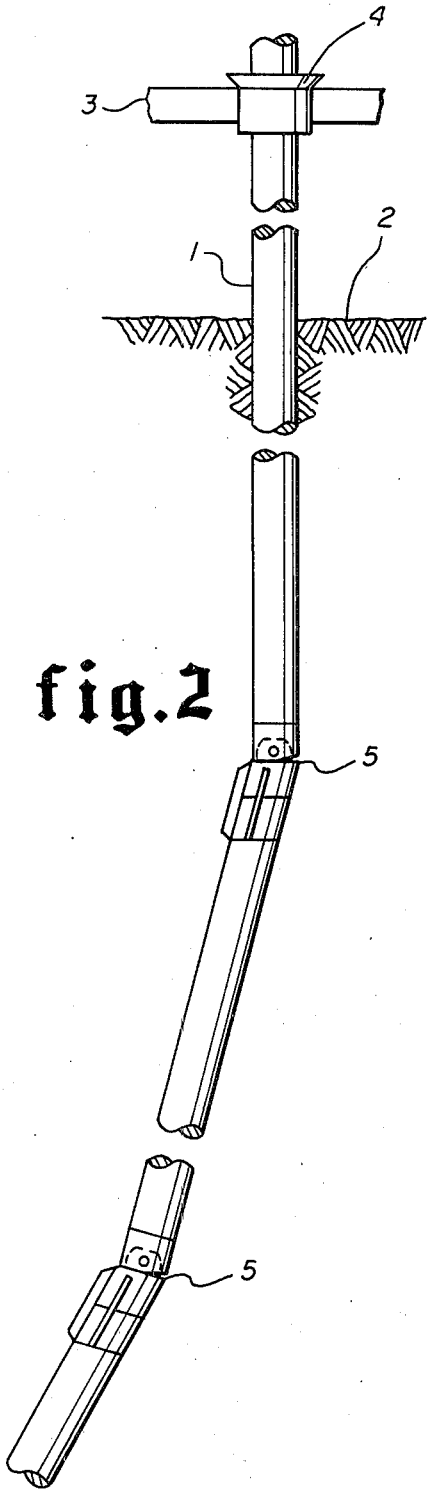
FIG. 2 is a frontal elevation of the conductor casing subsequent to a retraction of the shear pin and after the casing has penetrated the floor of FIG. 1.

With reference now to FIG. 1, there is shown a means for remote deviation of a linearly aligned conductor casing 11 being driven into the ocean floor 12 from the offshore platform 13 through a vertical guide 14. In FIG. 2, at a predetermined point beneath the ocean floor 12, the articulated shoe 15 is allowed to pivot, thus deviating the vertical path of the conductor casing.

Figure 3:
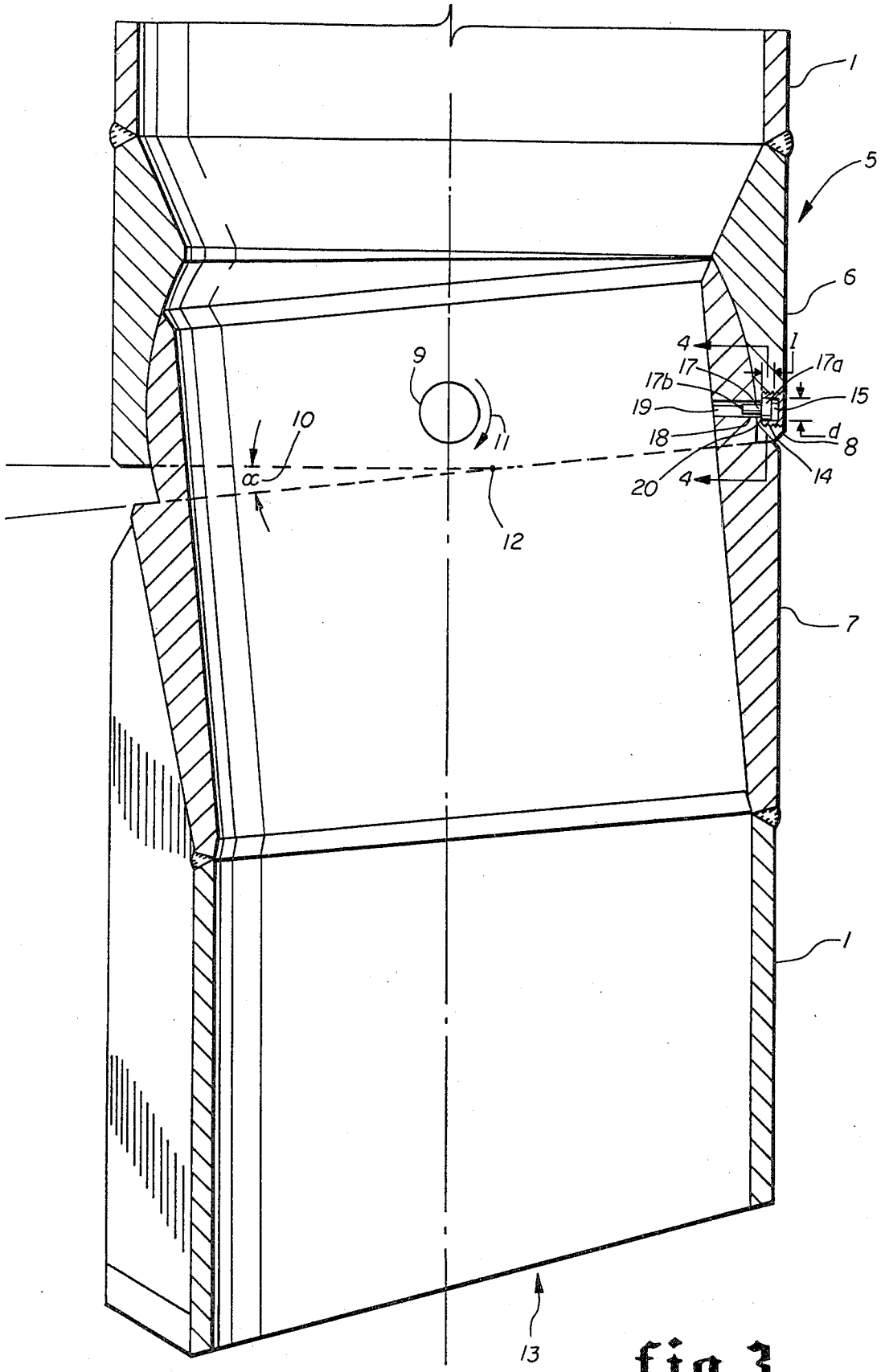
FIG. 3 is a vertical section view of the articulating shoe of FIG. 1 along plane 3—3 thereof.

FIG. 3 shows a detailed cross-section of the articulated shoe 15 affixed to two sections of the conductor casing 11 along plane 3—3 of FIG. 1. Briefly, the shoe 15 consists of an upper support means 16 and a lower movable shoe means 17, connected at a pivot point 19. The lower movable shoe means 17 is capable of pivotal movement with respect to the pivot point 19, through an arc 20. Placement of an eccentric fulcrum 22 assures a clockwise rotation 21 of the lower movable shoe means 17 when subjected to a resistive force 23, as when the conductor casing 11 is being driven into the ocean floor 12. However, and in accordance with the invention hereof, the presence of the improved shear pin 18 prevents rotational movement of the lower movable shoe means 17 until a predetermined time.

The improved shear pin 18 generally comprises a housing 24 of cup-like shape and which is threadedly or otherwise mounted in a recess of the upper support means 16. The cup-shaped housing 24 is characterized by a recess or cavity 25 and with respect to which a pressure differential actuating capability is imparted to the pin.

Contained within the cavity 25 of the housing 24 is a plug 27 which has two components, namely a cylinder **27*a* and a pin 27*b*. The cylinder 27*a* has a diameter or dimension "d" which forms a friction fit with the walls of the cavity 25 of the housing 24, but substantially shorter in length "l". The pin 27*b* projects through a bore 28 communicating with the cavity 25 of the upper support means 16 and projects into an aligned bore 29 in the lower movable shoe means 17. In this way, the shear pin mechanism 18, when engaged, precludes relative movement of the articulated shoe 15 and maintains it in aligned relationship with support means 16**.

The outer surface 30 of the plug 27 is exposed to the increased pressures encountered as the conductor casing 11 is driven to deeper depths. These pressures tend to force the plug 27 to retreat into the housing 24. However, the essence of the present invention involves the use of a means for locking or restraining the retraction of the plug 27 during the insertion of a string of conductor casing until the articulated joint reaches a desired subsurface depth. It is possible to predict with satisfactory accuracy the forces experienced at various depths. For instance, it is noted that a generally accepted constant for the increase in hydrostatic pressure with water depth is: 0.43 p.s.i/ft. If deviation is to occur at 500 ft., the indicated ambient pressure at that depth is (500 ft.)×(0.43 p.s.i./ft.)=215 p.s.i. If the diameter of the pin is given at 0.625 inches, the surface area would, of course, be 0.306 square inches. Thus, the force exerted thereon by the ambient pressure would equal: (215 p.s.i.)×(0.305 square inches)=65.8 pounds of force.

Figure 4:
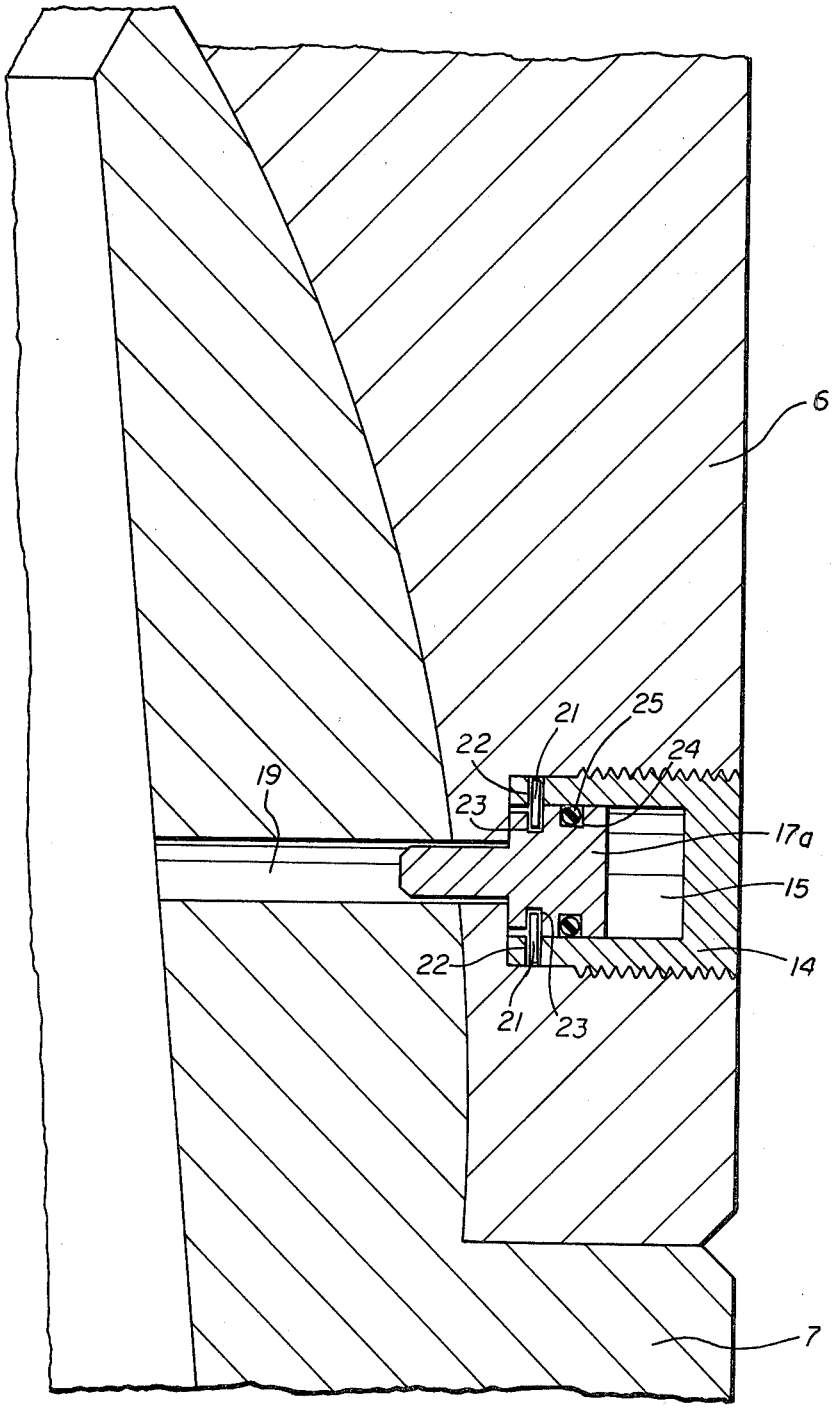
FIG. 4 shows a cross-sectional view along the plane 4—4 of FIG. 3 illustrating an embodiment of the hydrostatic shear pin.

In FIG. 4 the means for restraining the plug consists of a plurality of pins 21 extending through corresponding holes 22 and 32 in the housing 24 and cylinder **17*a* of the plug 17 so as to resist the force exerted by the pressure on the outer surface of the plug enountered at operating depths. The cavity 15 may be charged with air at atmospheric pressure, and that air thus has a negligible effect on the forces involved. A circumferential or perimetal groove 24 on the cylinder 17*a* contains an O-ring 25 so as to provide a seal between the cavity 25 and the outside pressure, but permitting a sliding fit between the cylinder 17*a* and the housing 24. Movement of the plug 17 is thus restrained until the force exerted by the ambient environment becomes high enough to shear the pins 21. Thereafter, the force exerted by the ambient pressure forces the shear pin 8 to disengage the cavity 19, allowing the articulated knee 15** to rotate as previously described.

It will be recognized that various factors influence the design and location of these restraining shear pins, including: the cross-sectional area of the pins; the material of the pins; the number of pins desired to be used; and a friction factor between the plug 17 and the interior surface of the housing 24.

Figure 5:
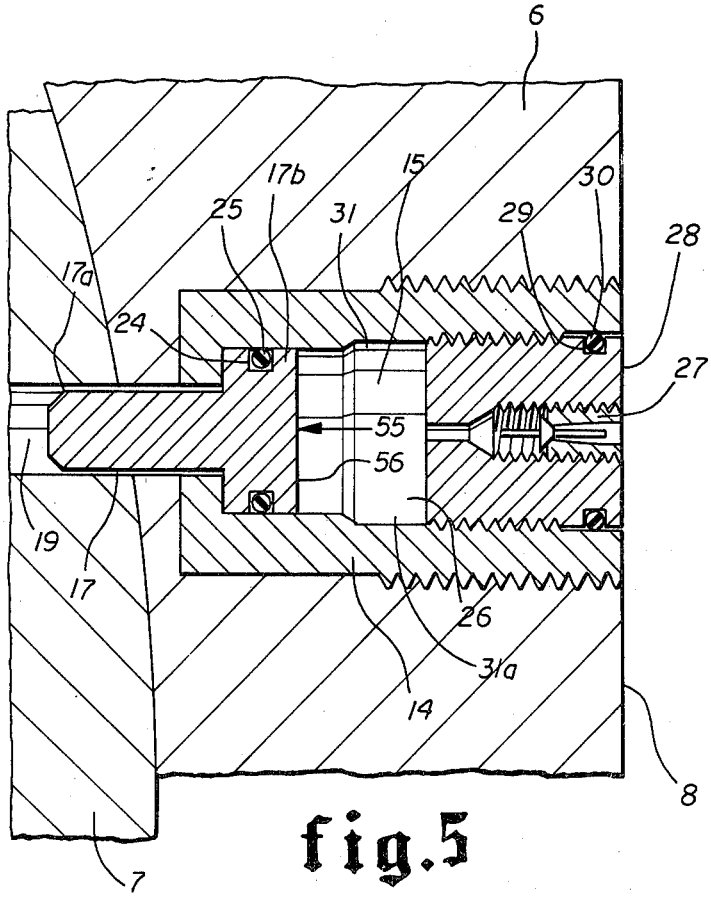
FIG. 5 shows a cross-sectional view of an alternative embodiment of the hydrostatic shear pin of FIG. 3 along plane 4—4.

In an alternative embodiment (FIG. 5) of the present invention, the engagement of the pin **27*b* with the lower shoe means 17 is maintained by application of an opposing force 55 to the back surface 56 of the plug 27. The force herein may be supplied by the presence of a pressurized gas 36, such as nitrogen ($N_2$) or other fluid or the like in the cavity 25. As in the earlier embodiment, the cylinder 27*a* may contain a concentric groove 34 on its outside surface and a conventional O-ring 35 therein, so as to provide an effective seal between the ambient environment and the cavity 25**.

The required amount of gas 36 to attain predetermined pressure is introduced into the cavity 25 through the use of a unidirectional gas transmission device 37, such as a Delcor valve. Such a valve may be inserted through back wall 38 of housing 24. The back wall may consist of a separate piece which is threadedly or otherwise mounted in said housing 24. The back wall contains a similar groove 39 and O-ring 40 arrangement as the cylinder **27*a*, so as to provide an effective seal to the cavity 25**.

In operation, the plug 27 will be forced back into the cavity 25 as the ambient pressure and hence resulting force increase with depth. Once the pin **27*b* of the plug 27 is retracted fully, the articulated knee 15 will be allowed to move freely. At that point, the cylinder portion 27*a* will retract into expanded recess 41 defined by shoulder 41*a* of the cavity 25. This recess is of larger diameter than the main body of the cavity 25. Once the cylinder portion 27*a* enters this recess, the pressurized gas 36 will be allowed to escape past the shoulder, through the recess to the ambient environment, thus insuring from that point forward that the plug 27 will not engage the recess 29 in the lower movable shoe means 17** and prevent movement thereby.

Numerous and varying different embodiments of the invention may be made within the scope of the inventive concept taught herein without departing from the scope thereof. For example, the force here illustrated as a fluid may be readily replaced by mechanical means, such as a spring or resilient material or the like deposed within the upper support means; and likewise remote operation of the pin by electronic signal may be utilized. Similarly, other changes, substitutions and modifications may be made within the spirit and scope of the inventive concept.

That which is desired to be secured by U.S. Letters Patent is:

1. An apparatus for selectively restraining and releasing relative rotational movement of a first component connected to a second component, comprising:

(a) a housing mounted in the first component, having an internal recess opening towards the second component;

(b) a plug having a first portion slidingly engaged and constrained within the recess of the housing, but not fully occupying the space therein, defining an inner surface of the plug facing the recess, and having a second portion projecting beyond the housing and the first component so as to engage in an aligned hole in the second component when the plug is fully extended with respect to the housing, said second portion defining an outer surface of the plug;

(c) conduit means for exposing the outer surface of the plug to ambient fluid pressure so as to tend to retract the plug into the recess;

(d) locking means for restraining the retracting of the plug until the force exerted by the ambient fluid pressure equals or exceeds the precalculated level, whereupon the locking means will disengage, allowing the plug to retract into the recess, thereupon permitting relative rotational movement of the first component with respect to the second component;

(e) said locking means comprising a plurality of rigid pins mutually engaging radially aligned holes in the retracting plug and housing, said rigid pins so constructed and arranged as to break at the application of the precalculated force acting upon the outer surface of the plug, (f) said locking means further including a quantity of pressurized gas sealed within the remaining space of the recess of the housing, (g) said housing further including a shoulder in the recess, said shoulder being of larger diameter than the recess, so as to allow the pressurized gas within said recess and shoulder to escape when said plug retracts fully into said shoulder.

2. The apparatus of claim 1 in which said locking means comprises a mechanical spring located within said housing, so constructed as to allow complete retraction of the plug only upon the application of a precalculated level of force acting upon the outer surface of the plug.

3. The apparatus of claim 1 in which said locking means comprises an elastic material such as rubber or plastic contained within said housing, so constructed as to allow complete retraction of the plug only upon the application of a precalculated force upon the outer surface of the plug.

4. The apparatus of claim 1 in which the locking means is remotely and electronically activated.

5. The apparatus of claim 1 in which the locking means comprises a solenoid engaged with the plug, the solenoid being electronically connected to a remotely located switch for activating or deactivating said solenoid.

6. An apparatus relative movement of a first object with respect to a second object, comprising:

(a) a first object comprising a housing having a recess therein;

(b) a second object sealingly and slidably engaged and constrained within said recess, but not fully occupying the space therein, defining an inner and outer surface with respect thereto;

(c) exposure means for subjecting the outer surface of the second object to a pressurized fluid, tending to retract the second object into the recess;

(d) locking means for restraining the retraction of the second object until the force exerted by the fluid pressure equals or exceeds a precalculated level, whereupon the locking means will disengage, allowing the second object to retract into the recess, (e) said locking means comprising a plurality of rigid pins mutually engaging radially aligned holes in the second object and housing, said rigid pins so constructed and arranged as to break at the application of a precalculated force acting upon the outer surface of the second object, (f) said locking means further including a quantity of pressurized gas sealed within the remaining space of the recess of said housing, (g) said housing further includes a shoulder in the recess, said shoulder being of larger diameter than the recess, so as to allow the pressurized gas within the recess to escape when said plug fully retracts into said shoulder.

7. The apparatus of claim 6 in which the locking means comprises a mechanical spring located within said housing, so constructed as to allow complete retraction of the second object only upon the application of a precalculated level of force acting upon the outer surface of the plug.

8. The apparatus of claim 6 in which the locking means comprises an elastic material such as rubber or plastic contained within said housing, so constructed as to allow complete retraction of the second object only upon the application of a precalculated force upon the outer surface of the second object.

9. The apparatus of claim 6 in which the locking means is remotely and electronically activated.

10. The apparatus of claim 9 in which the locking means comprises a solenoid engaged with the second object, the solenoid being electronically connected to a remotely located switch for activating or deactivating said solenoid.

* * * * *